US005874391A

United States Patent [19]

Meijer et al.

[11] Patent Number: 5,874,391

[45] Date of Patent: Feb. 23, 1999

[54] POLYMER THICKENED LUBRICATING GREASE

[75] Inventors: Dick Meijer, Nieuwegein; Herman Lankamp, Bunnik, both of Netherlands

[73] Assignee: SKF Industrial Trading & Development Company B.V., Nieuwegein, Netherlands

[21] Appl. No.: 526,175

[22] Filed: Sep. 11, 1995

[30] Foreign Application Priority Data

Sep. 9, 1994 [EP] European Pat. Off. ..... 94202610

[51] Int. Cl.[6] ..... C10M 143/04

[52] U.S. Cl. ..... 508/591; 585/10; 585/12

[58] Field of Search ..... 508/591; 585/12, 585/10

[56] References Cited

U.S. PATENT DOCUMENTS

| | | | |
|---|---|---|---|
| 2,901,432 | 8/1959 | Morway et al. | 585/12 |
| 2,917,458 | 12/1959 | Morway et al. | 585/12 |
| 3,076,764 | 2/1963 | Hansen et al. . | |
| 3,114,708 | 12/1963 | Morway et al. | 508/591 |
| 3,216,935 | 11/1965 | Morway et al. | 508/591 |
| 3,290,244 | 12/1966 | Polishuk et al. . | |
| 3,392,119 | 7/1968 | Mitacek . | |
| 3,850,828 | 11/1974 | Dodson et al. | 585/12 |
| 4,435,299 | 3/1984 | Carley et al. | 508/512 |
| 5,139,425 | 8/1992 | Daviet et al. . | |

FOREIGN PATENT DOCUMENTS

| | | |
|---|---|---|
| 699334 | 12/1964 | Canada . |
| 905924 | 7/1972 | Canada . |
| 0 675 192 A1 | 10/1995 | European Pat. Off. . |
| 0 700 986 A3 | 3/1996 | European Pat. Off. . |
| 2162016 | 7/1973 | France . |
| 6-322436 | 11/1994 | Japan . |
| 799465 | 10/1956 | United Kingdom . |

OTHER PUBLICATIONS

Chemical Abstracts, vol. 78, No. 14, Apr. 9, 1973, Columbus, Ohio, US; Abstract No. 86956m.

Chemical Abstracts, vol. 78, No. 14, Apr. 9, 1973, Columbus, Ohio, US; Abstract No. 86955k.

*Primary Examiner*—Sharon Gibson
*Assistant Examiner*—Cephia D. Toomer
*Attorney, Agent, or Firm*—Oliff & Berridge, PLC

[57] ABSTRACT

The present invention relates to a polymer thickener for lubricant grease compositions, wherein the thickener comprises a mixture of (1) a high molecular weight (co- or homo-)polymer of propylene with a weight average molecular weight ≧200,000 and (2) a low molecular weight (co- or homo-)polymer of propylene with a weight average molecular weight ≦100,000. The invention further relates to a lubricating grease composition comprising a lubricating oil and the above polymeric thickener, as well as a method for preparing said grease composition. Also, the invention relates to the use of such a polymer thickener in the preparation of lubricating grease compositions with improved oil bleeding characteristics at low temperature and improved noise characteristics and/or improved mechanical stability.

20 Claims, 4 Drawing Sheets

POLYMER THICKENED LUBRICATING GREASE

BACKGROUND OF THE INVENTION

The present invention relates to a polymeric thickener for lubricating grease compositions, comprising a high molecular weight component and a low molecular weight component.

US-A-3.850.828 describes a lubricant grease composition, which is thickened with a polymeric mixture, comprising (1) a polyethylene with a molecular weight of 20,000–500,000, more preferably 50,000–250,000 and preferred polymer density above 0,94 gm/cc, and (2) an atactic polypropylene with a molecular weight preferable below 100,000 and a melt index above 20, preferably above 50. The ratio of the atactic polypropylene to the polyethylene is preferably 1:1 to 1:10, more preferably 2:1 to 5:1.

U.S. Pat. No. 2,917,458 describes a grease composition comprising an oil soluble amorphous polypropylene base having a molecular weight in the range of 300–10,000 and an intrinsic viscosity up to 0.4, 2 to 5 wt. % of an isotactic polypropylene having a molecular weight in the range of 100,000 to 1,000,000 and a melting point in the range of 250° to 410° F., and 5 to 35 wt. % of a soap-salt thickener.

According to this application "( . . . ) high molecular weight isotactic polypropylenes can be satisfactorily incorporated in a grease containing mixed salts of high and low molecular weight organic acids, through the agency of an oil soluble amorphous polypropylene of select molecular weight ( . . . ). It has now been found that by the use of amorphous polypropylene of select molecular weight, the isotactic polypropylene is successfully made to blend with the oil."

Therefore, according to this reference, the low molecular weight amorphous polypropylene is dissolved in the oil and increases the compatibility of the oil with the isotactic polypropylene thickener. Also, according to this reference the grease always contains a conventional soap-salt thickener.

According to the present application the low molecular weight component is not dissolved in the oil, but forms part of the polymer thickener, as can be seen from the viscosity of the grease obtained.

U.S. Pat. No. 3,290,244 describes a grease composition comprising a mineral lubricating oil, a thickening agent, and an oil soluble atactic homopolymer of polypropylene having a molecular weight in the range of 10,000–50,000 or an oil soluble atactic copolymer of ethylene and propylene having an intrinsic viscosity in the range of 0.3 to 4.0.

As a thickener, conventional thickeners such as fatty acid metallic soaps, inorganic thickeners such a colloids, silica and bentonite clay, etc. can be used in amounts of 5 to 40%.

According to this reference, the oil soluble atactic propylene polymer is dissolved in the oil present in the grease and serves to improve adhesion and cohesion. The use of a high molecular weight/low molecular weight polymeric thickener is neither described nor suggested.

Also, all the above references are silent with respect to the oil bleeding characteristics and/or the noise characteristics of the grease compositions obtained.

U.S. Pat. No. 3,392,119 describes a grease comprising a white mineral oil that has been thickened by the use of an ethylene-copolymer with a density of 25° of at least 0.4 g/cm$^3$ and a polypropylene homopolymer with a density of 25° C. of between 0.890 and 9.20 g/cm$^3$, the polyethylene to polypropylene weight ratio generally being in the range from about 10:1 to 1:10, preferably 3:1 to about 1:2.

According to this application "it was unexpectedly found that not only do white oils respond differently to such polyolefin thickening than do conventional lube oils, but the bleeding of the white oils with a polymer of ethylene and a polymer of polypropylene results in greases having improved non-bleeding characteristics", i.e. with reduced bleeding of the oil. According to the present application a grease with improved bleeding of the oil at low temperatures is obtained. Although it is possible to employ a white mineral oil according to US-A-3,392,119 in the present invention it is less preferred, because it will generally lead to an inferior mechanical stability compared to the preferred embodiments described hereinbelow.

Also, this reference is again silent with respect to the noise characteristics of the grease composition.

SUMMARY OF THE INVENTION

One object of the present invention is to provide a polymer-thickened grease composition with good mechanical properties.

Another object of the invention is to provide a polymer-thickened grease composition with favourable oil bleeding characteristics.

A further object of the invention is to provide a polymer-thickened grease composition with excellent quiet running characteristics.

According to the present invention, these objects are achieved by the use in a lubricant grease composition of a polymeric thickener, substantially consisting of a mixture of (1) a (co- or homo-)polymer of propylene with an average molecular weight>200,000 and (2) a (co- or homo-) polymer of propylene with an average molecular weight<100,000. In a first aspect, the invention relates to such a polymeric thickener.

The invention further relates to a lubricant grease composition, comprising a lubricating base oil and a polymeric thickener according to the invention, as well as to a method for preparing said lubricant grease composition.

Three further aspects of the present invention relate to the use of a polymeric thickener according to the invention for the preparation of lubricating grease compositions with improved oil bleeding characteristics, especially at low temperatures, mechanical stability under shear, and for the preparation of lubricant grease compositions with improved quiet running characteristics, respectively.

DETAILED DESCRIPTION OF PREFERRED EMBODIMENTS

The polymeric thickener according to the present invention contains a high molecular weight component comprising a (co- or homo-)polymer of propylene with a weight average molecular weight >200,000, preferably 200,000–500,000 and a low molecular weight component comprising a (co- or homo-) polymer of propylene with a weight average molecular weight ≦100,000, preferably 50,000–100,000.

The weight ratio between the high molecular weight component and the low molecular weight component in the polymeric thickener is preferably 1:40–1:5, more preferably 1:25–1:15, more preferably about 1:19.

Outside this preferred range for the weight ratio between the high and low molecular weight components the final lubricating grease composition will generally not have the desired application properties, in particular mechanical stability and consistency, i.e. be too "rubbery/elastic" and/or too "buttery". However, as the properties of the final composition are also dependent on the lubricant base oil and additives incorporated in grease compositions, as well as on the way the composition is prepared, other ratios may also be used for obtaining the desired properties of the final composition, as is well known to a man skilled in the art.

According to the present invention, the low molecular weight component is preferably a polypropylene homopolymer, more preferably a polypropylene homopolymer with a melt flow rate of 500–1000 dg/min., especially 750–850 dg/min. as determined by test ASTM D 1238 L.

The high molecular weight component preferably has a melt flow rate (ASTM D-1238) of 1.5–15, more preferably 1.5–7, especially about 3.5.

Lubricant grease compositions which are thickened with a polymeric thickener according to the invention, and which further comprise one or more lubricating base-oils and additives known per se, show the following advantages:

- improved bleeding of the oil at low temperatures (room temperature [20° C.] or less);
- oil bleeding characteristics that are less temperature-dependent than the characteristics of lubricant grease compositions known in the state of the art;
- better transport of the oil within the grease structure, which leads to improved grease service life;
- good lubricating ability at low temperatures (below 70° C.);
- good mechanical stability, i.e. "roll" stability/shear stability;
- improved grease noise characteristics, i.e. a lower noise level of the lubricated bearing in the SKF BEQUIET-test;
- long relubrication intervals.

Further advantages of the present invention will be clear from the discussion herein below.

Lubricating greases comprise a lubricating base oil and a thickener. During service of the lubricant grease, the oil bleeds out of the oil/thickener-structure onto the surfaces of the bearing, thereby providing the lubricating action. The oil bleeding characteristics at the service temperature of the lubricant grease composition (i.e. the running temperature of the bearing, as well as the "start up" temperature) are therefore critical for obtaining the lubricating action of the composition.

In current lubricating greases, such as soap-thickened greases, the oil bleeding characteristics are strongly dependent on temperature. In low temperature applications (such as in windmills) the bleeding of the oil of conventional greases is often so low that oil starvation occurs, i.e. no sufficient oil is released from the grease composition. It has now been found that polymer-thickened greases give a significant higher bleeding of the oil from the grease composition at low temperatures.

However, not all polymer-thickened grease compositions show an acceptable mechanical stability and consistency. Poor mechanical stability leads to a collapse of the grease structure upon shearing, resulting in an undue grease leakage and undesirable reduction of grease life. Furthermore, some polymeric greases appear to be very "noisy", which means that during service, the lubricated bearing produces a lot of noise. Such drawbacks are not present in the case of compositions according to the invention.

Summarized, the aim of the present invention is to provide a polymer thickened grease composition which combines the properties of both favourable oil bleeding characteristics at low temperatures, good mechanical stability and consistency and favourable noise characteristics.

The oil bleeding characteristics or oil separation properties of the polymeric thickened grease composition should be such that continuously an effective amount of oil is provided at the running temperatures of the bearing, which are influenced by the ambient temperature. In for instance windmill applications the ambient temperatures lie generally between −10° C. and 50° C., as a consequence the running temperature will be between −0° C. and 80° C. The polymer thickened grease composition according to the present invention provide acceptable oil separation at temperatures as low as −0° C.

Also, the temperature-dependency of the oil bleeding characteristics should be as small as possible, i.e. the oil separation should not decrease strongly as the temperature decreases. Grease compositions according to the state of the art often show an oil separation which is acceptable or even too high at moderate temperatures, for instance 70°–80° C., but very poor at lower temperatures, for instance below 30° C. The use of the polymer thickener according to the present invention provides improved oil bleeding characteristics in the sense that the course of the oil bleeding is less dependant on temperature, especially in the low temperature range.

Methods for the determination of oil bleeding characteristics are well known to a man skilled in the art, see for example DIN 51817.

A further advantage of the polymeric thickener according to the present invention is the improved transport of the lubricating base oil within the grease structure.

During service of the grease, the oil bleeds out at the surface of the grease structure. The oil separated at the surface should be replenished with oil from the "inside" of the grease structure through oil transport within the grease structure itself. In conventional greases, this oil transport is often very poor, resulting in a reduction of the amount of oil available for lubrication at the surface of the grease structure, even though the grease structure as such still contains enough oil. This effect contributes to a reduction of grease life and even starvation, so that frequent relubrication is required. In greases which are thickened with the polymeric thickener according to the invention the oil transport within the grease structure is improved as can be seen from oil bleeding tests according to DIN 51817 which shows a threedimensional shrinkage of the grease sample.

The mechanical stability of the grease is dependent on the thickener used, the lubricating base oil used, as well as the additives used. Further, the mechanical properties of the grease can be influenced by "working" the grease after the thickener is mixed with the lubricating base oil, as is well known to a man skilled in the art of lubricants. Preferably, the grease is "worked" to a consistency desired and/or required for its intended use.

The mechanical stability of the grease can be ascertained by means of tests known in the art, such as the Shell roll stability test. Preferably, the grease will have a penetration after the Shell roll stability test (24 hrs at 60° C., 165 rpm), of max. 350.

The consistency of the grease can be classified by means of the NLGI-class. According to the present invention the grease can usually be prepared to a NLGI-class range 1 to 3. An NLGI-class of 0 can be made, however, will usually give undue grease leakage.

It must be understood, however, that the present invention allows the man skilled in the art to obtain a grease with the consistency and mechanical stability as desired and/or required for the intended application of the grease by selecting the components as well as the conditions for preparing the grease, which aspects fall within the scope of a man skilled in the art of lubricants.

Also, the viscosity of the separated oil must be acceptable, and preferably be constant.

For practical applications, the amount of noise produced by the lubricated bearing during service should obviously be as low as possible. Also, the noise produced by a bearing gives an indication of efficiency of the lubrication process and the amount of damage by particle overrolling occurring in the bearing.

The noise level produced by a bearing is not only dependent on the properties of the bearing itself and on the conditions under which the bearing is operated, but also on the noise characteristics of the grease composition used. Grease noise characteristics can be determined by means of the SKF BEQUIET grease noise tester, which is described in the SKF publication E4147.

The lubricant grease compositions according to the present invention show very favourable quiet running characteristics and mechanical stability, especially if the polymer-thickened grease is prepared by the preferred rapid cooling method called "quenching", as will be described hereinbelow.

The above properties of the final grease composition are of course also dependent on the properties of the lubricating oil and additives used in the final grease composition, as is well known to a man skilled in the art. For optimizing the polymer-thickened lubricants the following parameters are also important: the ratio of the polymeric components in the thickener mixture, the cooling speed during preparation and pre-working procedures.

The polymer thickener according to the invention is generally used in the lubricating grease composition in conventional amounts, i.e. from 1–20, preferably 5–15, especially about 10 percent by weight of the total grease composition. Other amounts can be used if desired.

Apart from the polymeric thickener according to the invention, the lubricant grease composition may also contain conventional thickeners for lubricant grease compositions, such as metal soaps, in amounts of less than 50 wt. %, preferably less than 10 wt. %, as well as other polymeric thickeners.

Most preferably, however, the lubricant grease compositions according to the invention do contain only polymeric thickeners, most preferably the polymeric thickener mixture as described hereinabove.

As the lubricating base oil any lubricating oil known per se may be used, such as mineral oils, synthetic hydrocarbons, ester oils and mixtures thereof, of different viscosity. The type of base oil and viscosity can be selected to suit specific applications.

Furthermore, additives known per se may be incorporated in the lubricant grease composition, as long as they do not have a detrimental effect on the thickener composition, the base oil and/or the final grease composition. As such, anti-wear and anti-corrosion additives as well as anti-oxidants may be incorporated in conventional amounts in a manner known per se.

The present invention further relates to a method for preparing the lubricant grease composition according to the invention, comprising the following steps:

(a) preparing a polymeric thickener composition according to the invention;

(b) mixing the obtained thickener composition with one or more lubricating base oils at a temperature of 150°–250° C., preferably 190°–210° C.; and (c) cooling the grease composition thus obtained.

The polymeric thickener composition according to the invention is prepared by mixing the polymers in a manner known per se, which can optionally involve heating and/or the use of suitable solvents.

The polymers of the subject invention are mixed with a lubricating base oil and optional additives by means of conventional techniques known per se resulting in the lubricating grease composition according to the invention.

The preparation of the grease composition should preferably be carried out under a protective atmosphere, such as a nitrogen gasflow, for avoiding oxidation of the oils during heating.

According to a preferred embodiment the solid polymeric components and the lubricating base oil are heated together (preferably under stirring) to a temperature above the melting point of polypropylene, preferably 190°–210° C., although other temperatures may be used if required.

After the polymers are dissolved in the lubricating base oil and optionally additives have been added, the grease is cooled from the mixing temperature to room temperature.

According to an especially preferred embodiment of the invention this cooling is carried out in a period of time between 1 sec.–3 min., preferably 10 sec.–1 min., more preferably about 30 sec. This rapid cooling process, which forms an important aspect of the invention, will be indicated hereinbelow as "quenching". The quenching of the lubricant grease composition can be carried out, for instance, by pouring the grease composition on a water-cooled metal plate, although any other suitable rapid cooling method may also be used, such as spraying.

The quenching process according to the invention has a major influence on the grease structure, giving significant improvement of the properties of the final grease compositions compared to both conventional lubricating greases, as well as lubricating greases according to the invention which are cooled slowly, e.g. in approximately 1 degree per minute by the use of conventional cooling methods, such as simply keeping the grease in the reaction vessel with external/internal cooling. This results, for the polymer grease, in a lubricant lacking any mechanical stability.

In the polymer-thickened lubricating grease according to the invention, the polymeric thickener forms a sponge-like structure, which gives the grease its appearance and structure. The lubricating base oil is kept within the pore-like spaces within the thickener structure, and bleeds out during service of the grease.

As can be seen from the appended scanning electron micrographs (SEM) photographs, in greases which are slowly cooled during their preparation, the thickener-structure is very irregular with large pores as well as very small pores. The above indicated quenching of the lubricant grease composition provides a grease according to the invention with a smoother and more uniform structure of the polymeric thickener, with more uniformly distributed spaces for keeping the lubricant oil.

Although in its broadest sense the invention is not restricted to any method for preparing the grease nor to any explanation as to how the improved properties of the grease composition according to the invention are obtained, it is believed that the smoother and more uniform thickener structure obtained by quenching has a beneficial influence on the final properties of the grease composition, such as the mechanical properties, the oil bleeding characteristics, the noise characteristics, as well as the transport of the oil within the grease structure, so that the properties of the polymer-thickened grease compositions obtained by the use of the polymeric thickener according to the invention are improved even further.

After the grease lubricant composition is cooled, preferably quenched, the grease is "worked" to the required final consistency in a conventional manner, for instance in a three-roll mill or a grease worker. During the working of the grease, further additives can be added as is well known to a man skilled in the art. After "working", the grease is ready for use.

The polymer-thickened grease composition according to the present invention can be used for all conventional applications for lubricant grease compositions, so long as these are compatible with the components of the lubricant grease composition.

As stated hereinabove, the superior oil bleeding characteristics at lower temperature makes the lubricant greases according to the invention especially suited for low temperature applications, for instance windmills. Also, on account of the long(er) relubrication intervals compared to conventional greases, the compositions according to the invention can advantageously be used in applications for which frequent relubrication is unpractical or undesired.

Further uses of the lubricant grease compositions according to the present invention are e.g. agricultural machinery, bearings in dam-gates, low noise electric motors, large size electric motors, fans for cooling units, machine tool spindles, screw conveyor.

The present invention further relates to a grease composition obtainable according to the method of the invention.

Furthermore the invention relates to the use of polymer thickener as described hereinabove in the preparation of a lubricant grease composition with improved oil bleeding characteristics at low temperatures (<70° C.).

The invention also relates to the use of a polymeric thickener as described hereinabove for the preparation of a lubricant grease composition with improved noise characteristics.

The invention will now be further illustrated by the following figures and examples, which do not limit the invention in any way:

BRIEF DESCRIPTION OF THE DRAWINGS

FIG. 2 shows three scanning electron micrographs of the same grease composition according to the invention, prepared by quenching, at the same magnification of 1000, 5000 and 10,000 respectively.

Figure 1A:
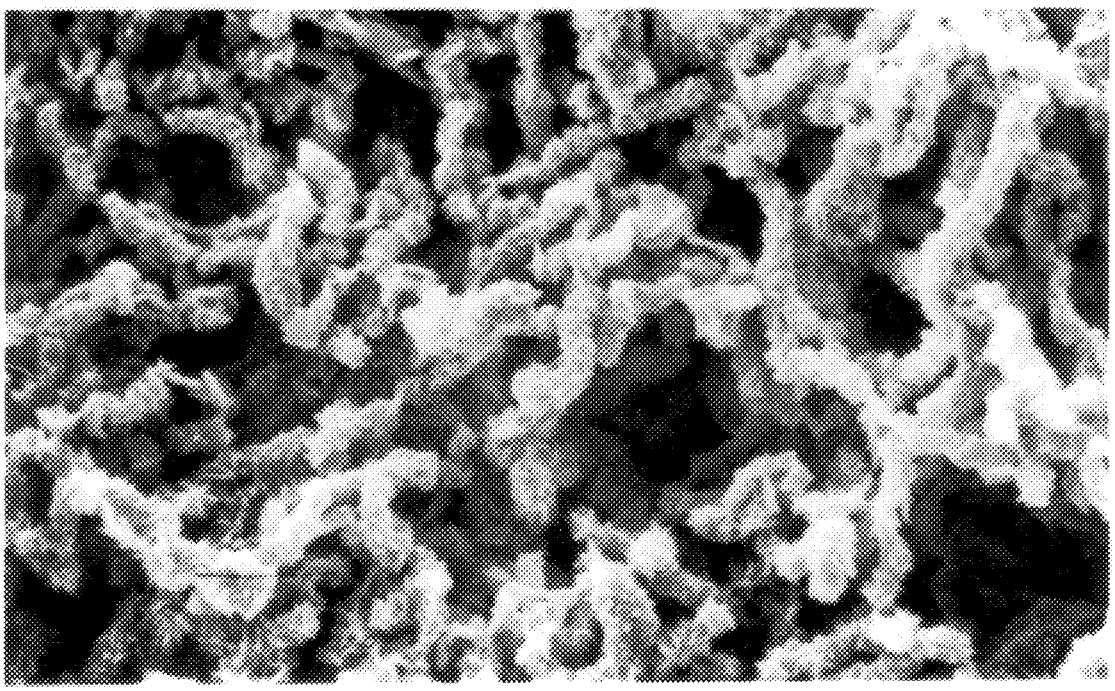
Figure 1B:
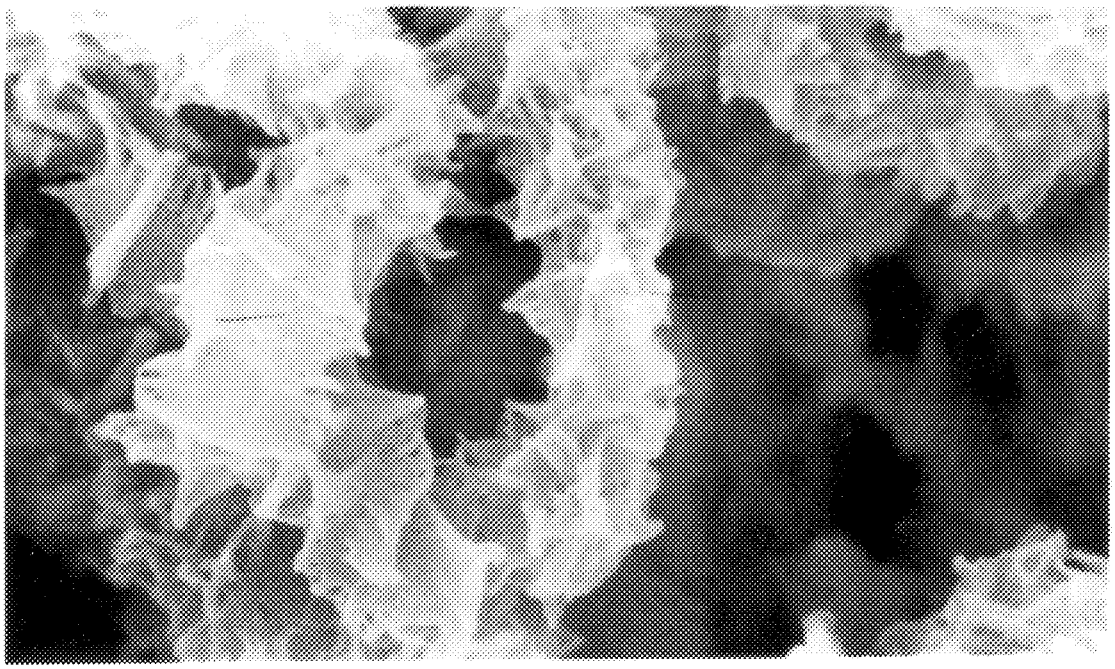
Figure 1C:
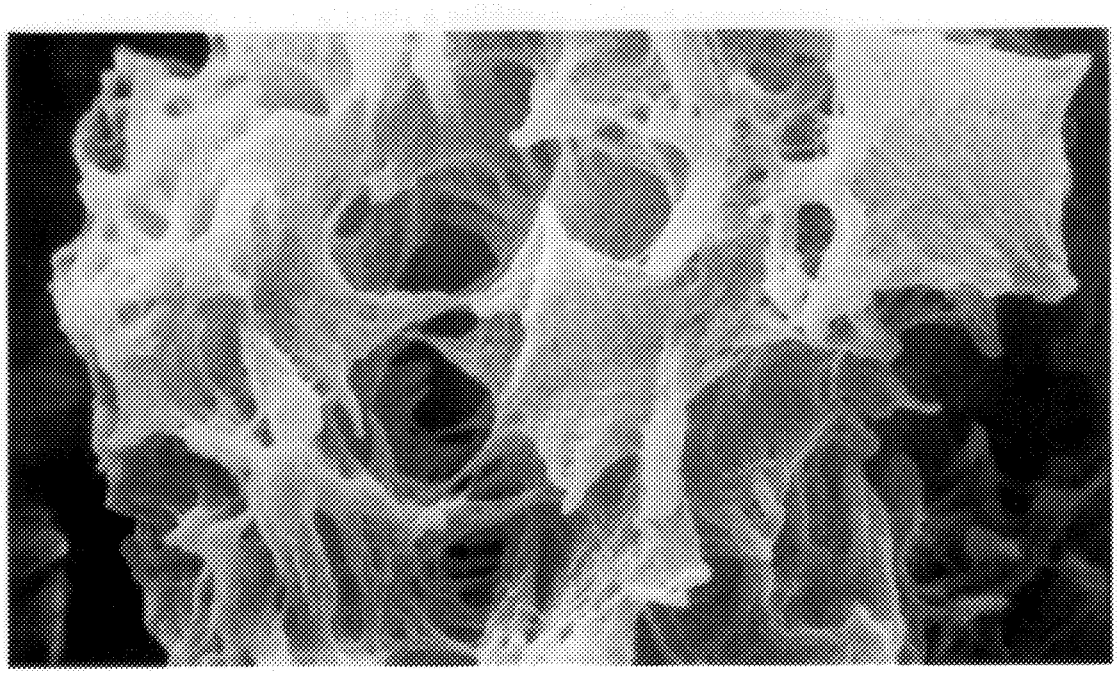
Figure 2A:
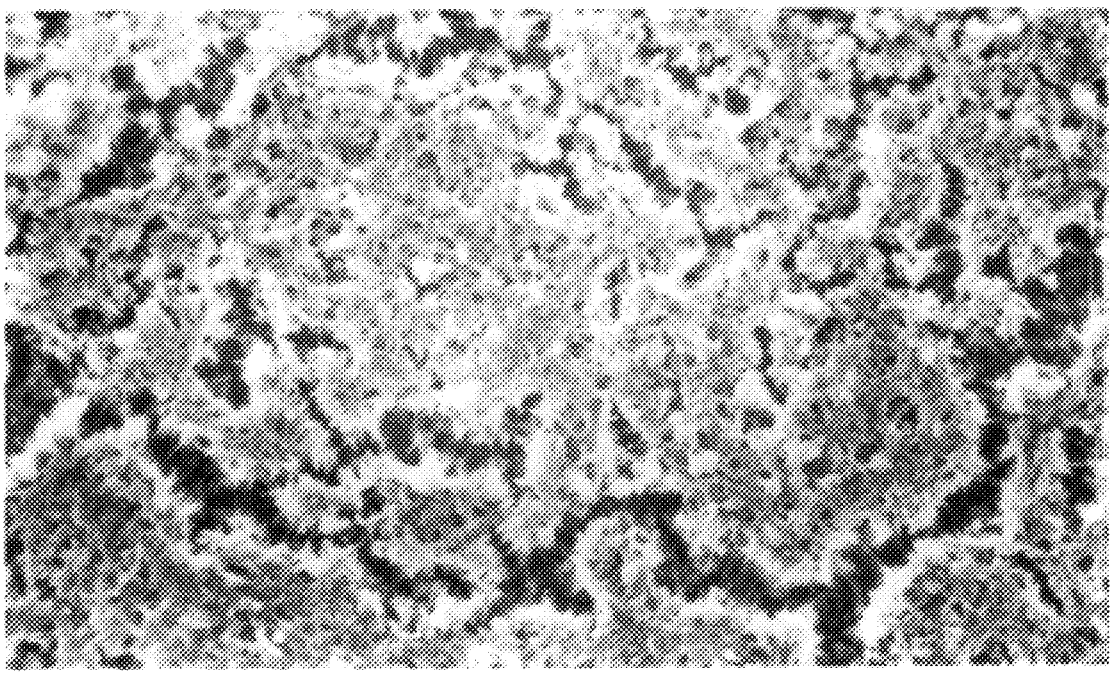
FIGS. 2A, 2B, and 2C show three scanning electron micrographs of a grease of Example 1 according to the invention, prepared with slow cooling, at magnifications of 1000, 5000 and 10,000 respectively.
Figure 2B:
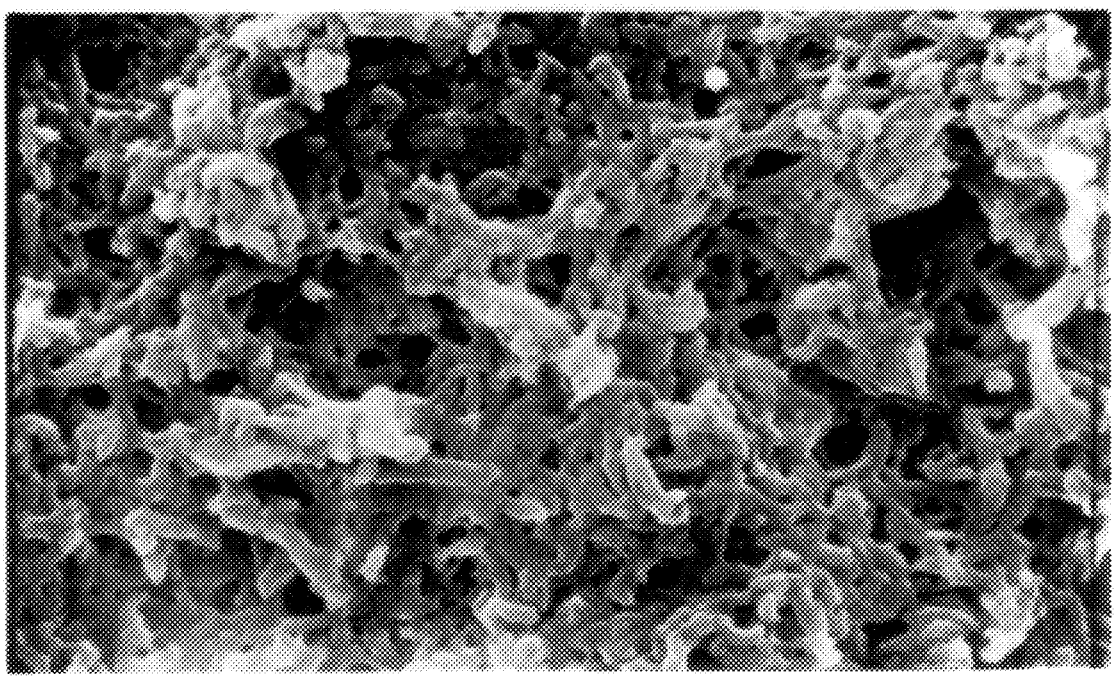
Figure 2C:
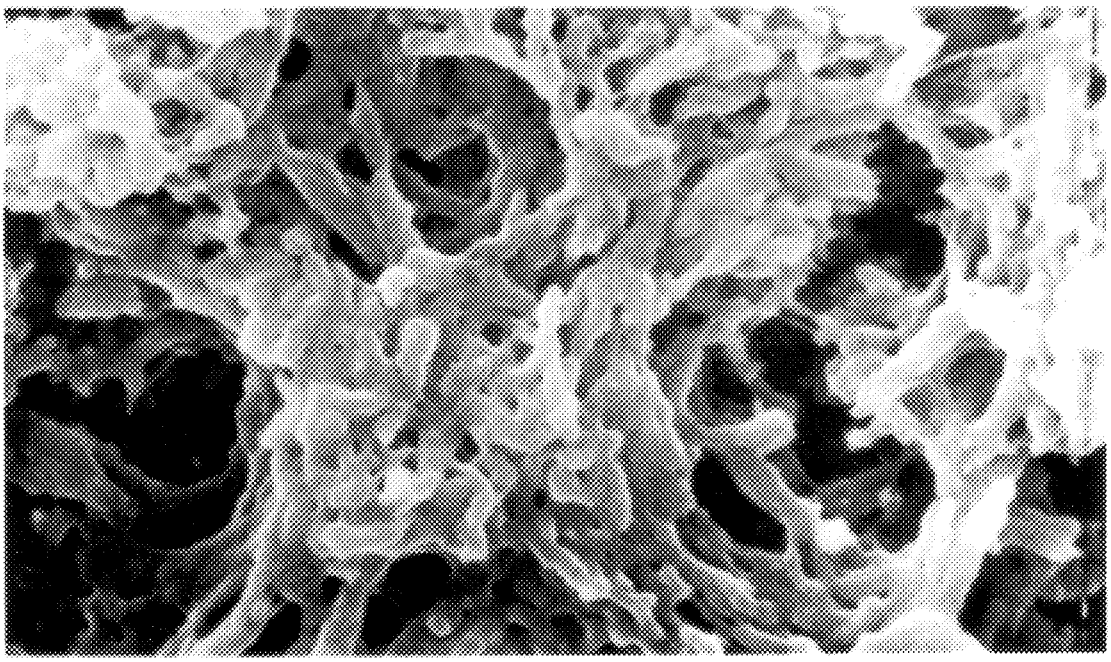

Example 1 shows the effect of cooling on the properties of the polymer thickened grease.

In Example 2 a comparison of oil bleeding characteristics is given for polymer thickened lubricants versus conventional greases.

Example 3 shows the effect of polymer composition on grease appearance/texture.

Example 4 is the functional performance of the polymer thickend lubricating grease.

EXAMPLE 1

Effect of cooling on properties of polymer grease. Polymer grease composition:

high molecular weight polypropylene (average mw.230,000) 0.5% low molecular weight polypropylene (average mw. 82,000) 9.5% base-oil: synthetic hydrocarbon/ester mixture, viscosity 68 $mm^2/s$ 82.5% anti-oxidant and anti-wear additives 7.5%

Method of preparation:

Polypropylenes are mixed with base-oil, heated under nitrogen to 195° C. until complete dissolution of polypropylenes has taken place.

The solution is cooled down in two ways, i.e.

a) by slow cooling in vessel, b) by pouring onto a cold metal plate.

Resulting properties:

| Cooling | Penetration after 60 strokes DIN 51804 | Penetration after 5000 strokes DIN ISO 2137 | Quiet running behaviour SKF BEQUIET average peak μm/s |
|---|---|---|---|
| method 'a' 1 | 320 | 360 | 58.0 |
| 2 | >420 | | 138 |
| method 'a' 1 | 213 | 277 | 5.4 |
| 2 | 223 | 278 | 6.6 |

Conclusion:

The rapid quenching method gives improved mechanical stability and noise characteristics.

EXAMPLE 2

Oil bleeding characteristics of polymer grease versus conventional greases as function of temperature.

Composition polymer grease: see example 1.

Method of preparation: see example 1, method 'b'.

Test method: Oil separation in % according to DIN 51817

| NLGI-class 2 | Test temperature [°C.] | | | |
|---|---|---|---|---|
| grease | −0 | 20 | 40 | 70 |
| polymer grease | 1 | 3.8 | 8.5 | 14 |
| SKF LGEP2 | 0 | 0.7 | 5 | 9 |
| SKF LGMT2 | 0.4 | 1.3 | 6 | 12 |

Conclusion:

While conventional Li-soap greases virtually stop in oil bleeding at temperatures below 20° C., the polymer grease continues to give oil separation.

EXAMPLE 3

Effect of polymer composition on final grease appearance

Composition polymer grease: see example 1.

Method of preparation: see example 1, method 'b'.

| polymer grease composition | grease texture/appearance |
|---|---|
| 100% high molecular weight polypropylene | stiff as tar |
| high and low molecular weight polypropylene, ratio 1:1 | rubbery/elastic |
| high and low molecular weight polypropylene, ratio 1:4 | rubbery/smooth |
| high and low molecular weight polypropylene, ratio 1:19 | smooth |
| 100% low molecular weight polypropylene | soft as butter |

EXAMPLE 4

Functional performance of polymer thickened grease.

Composition polymer grease: see example 1.

Method of preparation: see example 1, method 'b'.

| Test method and conditions | | Standard | Findings |
|---|---|---|---|
| Grease service life; | | SKF ROF | average grease |
| bearing type: | 6204 C3/2Z | test method | life of 2000 hours |
| speed: | 10,000 rpm | | |
| temperature: | 120° C. | | |
| grease filling: | 1.4 g | | |
| Lubricating ability in cold chamber test; | | In analogy to SKF R2F | no bearing failure at ambient |
| bearing type: | 22310 CC/C3 | method A | temperature (= in cold chamber) down to −20° C. |
| speed: | 1600 rpm | | |
| radial load: | 7 kN | | |
| temperature cycle: | | | |
| start at 20° C. and cooling down steps of 10 degrees per day until −30° C. | | | |

What is claimed is:

1. Polymeric thickener for lubricating grease compositions, comprising a high molecular weight component and a low molecular weight component, wherein the thickener comprises a mixture of (1) a (co- or homo-) polymer of propylene with a weight average molecular weight >200,000 and (2) a (co- or homo-)polymer of propylene with a weight average molecular weight between 50,000 and 100,000.

2. Thickener according to claim 1, in which the ratio between the high molecular weight component and the low molecular weight component is 1:40–1:5.

3. Thickener according to claim 1, in which the low molecular weight component is a polypropylene homopolymer.

4. Thickener according to claim 1, in which the low molecular weight component has a melt flow rate (ASTM D-1238) of 500–1000.

5. Thickener according to claim 1, in which the high molecular weight component is a polypropylene homopolymer or a propylene/ethylene-copolymer.

6. Thickener according to claim 1, in which the high molecular weight component has an average molecular weight of 200,000–250,000 and a melt flow rate (ASTM D-1238) of 1.5–15.

7. Lubricating grease composition, comprising a lubricating base oil and a polymeric thickener, comprising a high molecular weight component and a low molecular weight component, wherein the grease composition comprises a thickener according to claim 1.

8. Method for preparing a grease composition comprising the following steps:

a) preparing a thickener composition according to claim 1, b) mixing the thickener with a lubricating base oil at a temperature above a melting point of the thickener polymers, and c) cooling the grease composition thus obtained such that the thickener forms a three-dimensional porous structure holding the lubricating base oil in pores of the structure.

9. Method according to claim 8, according to which the grease composition is cooled from the mixing temperature to room temperature in 1 sec.–3 min.

10. Method according to claim 8, in which anti-wear additives, anti-corrosion additives and anti-oxidants are added to the grease composition.

11. Grease composition, obtained according to the method of claim 8.

12. Thickener according to claim 2, in which the ratio between the high molecular weight component and the low molecular weight component is 1:25–1:15.

13. Thickener according to claim 2, in which the ratio between the high molecular weight component and the low molecular weight component is 1:19.

14. Thickener according to claim 4, in which the low molecular weight component has a melt flow rate (ASTM D-1238) of 750–850.

15. Thickener according to claim 6, in which the high molecular weight component has a melt flow rate (ASTM D-1238) of 1.5–7.

16. Method according to claim 8, in which said mixing is at a temperature of 190°–210° C.

17. Method according to claim 9, in which said cooling is conducted in 10 sec.–1 min.

18. Method according to claim 9, in which said cooling is conducted in 30 sec.

19. Lubricating grease composition according to claim 7, wherein said polymeric thickener is the only thickener present in said grease composition.

20. Lubricating grease composition according to claim 7, wherein the thickener is a three-dimensional porous structure and the lubricating base oil is within pores of the three-dimensional porous structure.

* * * * *